US006505383B2

(12) United States Patent
Machacek et al.

(10) Patent No.: US 6,505,383 B2
(45) Date of Patent: Jan. 14, 2003

(54) RECLOSABLE ZIPPER STRIP WITH COATED WEBS

(75) Inventors: Zdenek Machacek, Nanuet, NY (US); John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/772,823

(22) Filed: Jan. 30, 2001

(65) Prior Publication Data

US 2002/0100144 A1 Aug. 1, 2002

(51) Int. Cl.[7] ..... B65D 33/25; B65D 77/10

(52) U.S. Cl. ..... 24/30.5 R; 24/30.5 P; 24/399; 24/400; 24/585.12

(58) Field of Search ..... 24/30.5 R, 30.5 P, 24/587, 399, 400, 576

(56) References Cited

U.S. PATENT DOCUMENTS 3,991,801 A * 11/1976 Ausnit ..... 24/576
4,878,763 A * 11/1989 Ausnit ..... 24/587
5,007,146 A * 4/1991 Meidan ..... 24/587
5,672,009 A * 9/1997 Malin ..... 24/587
5,931,582 A * 8/1999 Nichols ..... 24/587
6,115,892 A * 9/2000 Malin et al. ..... 24/587
6,183,134 B1 * 2/2001 Malin ..... 24/587
6,222,128 B1 * 4/2001 Gretz ..... 24/16 PB
6,327,754 B1 * 12/2001 Belmont et al. ..... 24/400

FOREIGN PATENT DOCUMENTS

EP 0398732 * 11/1990 ..... 24/587

* cited by examiner

*Primary Examiner*—Victor Sakran
(74) *Attorney, Agent, or Firm*—Pitney, Hardin, Kipp & Szuch LLP

(57) ABSTRACT

A zipper strip has a base member from which first and second profiles extend upwardly. Each of the profiles includes an arm having one of a set of interlocking member attached. The base member including a first web extending between the arms; a second web, outboard of the first arm; and a third web, outboard of said second arm. One or both surface of the webs may be coated with a sealant and/or peel seal material to imparted desired characteristics to the package formed with the zipper.

12 Claims, 2 Drawing Sheets

RECLOSABLE ZIPPER STRIP WITH COATED WEBS

BACKGROUND OF THE INVENTION

The present invention relates to reclosable plastic bags and, in particular to a zipper strip for use in the manufacture of such bags.

As reclosable plastic bags become increasingly more popular as primary packaging for food stuffs and other commodities, the need has arisen for more complex closures such as those featuring slider operated fasteners that can be used to manufacture more sophisticated packages. For example, certain foods require hermetic packaging. Accordingly, the closure is required to carry a hermetic seal, either above or below the interlocking elements of the zipper to insure the integrity of the package. In many applications the closure is required to provide for tamper resistance or, at least evidence any tampering. This may be accomplished by providing a rupturable membrane or peel seal either above or below the interlocking elements or a header surrounding the zipper interlocking elements which must be ruptured to gain access to the package contents. Another desirable feature for many packages is the provision of a hang tag to enhance the display of the package.

Heretofore, the closures and packaging techniques were required to be more or less custom designed to provide the particular features required. This customized packaging is inherently expensive and the need has arisen for a universal closure which, with relatively minimum alteration and expense can be used in a wide variety of applications.

SUMMARY OF THE INVENTION

In view of the above, it is a principal object of the present invention to provide a zipper strip, particularly one having an associated slider, which, with relatively slight modifications in the method of its attachment can provide a wide range of features to a resultant package.

A further object is to provide such a strip which, may relatively easily be modified, as required to provide desired features to a resultant package.

A still further object is to provide such a zipper strip that may readily be utilized in existing form, fill and seal equipment.

The above and other beneficial objects and advantages are attained in accordance with the present invention by providing an improved zipper strip having a base member from which first and second profiles extend upwardly. Each of the profiles comprises an arm having one of a set of interlocking members attached. The base member including a first web extending between the arms; a second web, outboard of the first arm; and a third web, outboard of said second arm. One or both surface of the webs may be coated and/or the webs may be perforated to thereby impart desired characteristics to the package formed with the zipper.

DETAILED DESCRIPTION OF THE PREFERRED EMBODIMENT

Figure 1:
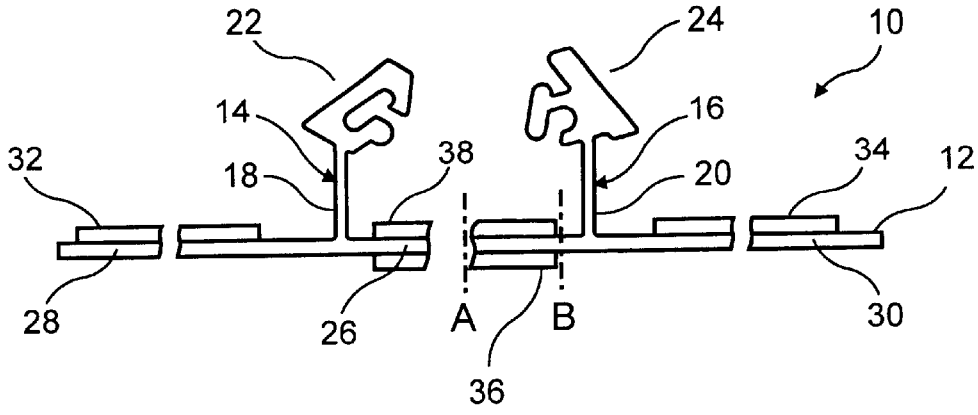
FIG. 1 is a side elevational view of a zipper strip in accordance with the present invention.

Reference is now made to the drawings and to FIG. 1 in particular wherein a zipper strip 10 in accordance with the present invention is depicted as including a base 12 from which profiles 14 and 16 extend upwardly. The profiles each include an arm 18, 20 attached at one end to the base and carrying an interlocking member 22, 24 designed to mate with one another at the free end. The interlocking members may be any of many configurations that are well known those skilled in the art. If desired the interlocking members may be designed to accommodate a slider to facilitate opening and closing. The base 12 is defin ed by a first web 26 between the arms 18, 20; a second web 28 outboard of the first arm 18 and a third web 30 outboard of the second arm 20.

In accordance with the present invention coating 32, 34 are provided on the top surfaces of the second and third webs and coatings 36 and 38 are provided respectively to the bottom and top surfaces of the first web. The coatings may comprise a sealant material, a peel seal material or a non-seal material. The specific coatings used are determined by the packages to be formed with the zipper strip as exemplified in FIGS. 2–6.

Figure 2:
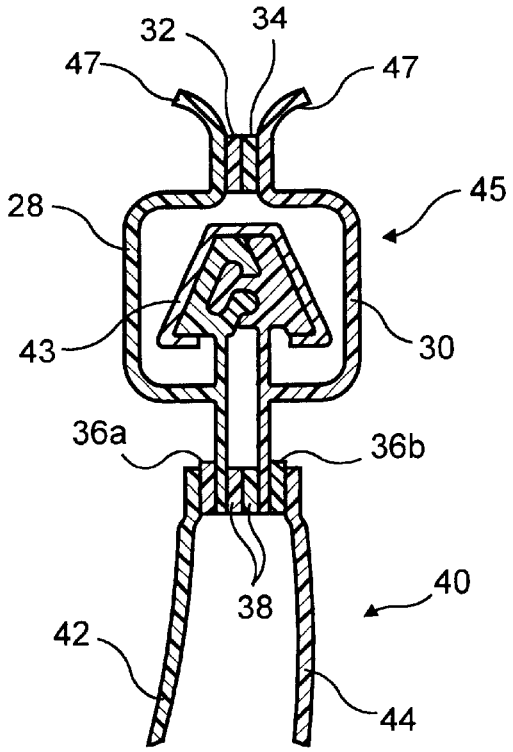
FIG. 2 is a fragmentary sectional view of a first package that may be formed with the zipper strip of FIG. 1 when suitably coated.

In FIG. 2 a package 40 is depicted having a header 45 enclosing the zipper and its slider 43. In this case the coatings 32 and 34 are formed of a peel seal material which may readily be separated by the consumer to gain access to the zipper. Further, the opening of the peel seal is evident. In this embodiment the center web is split at "A" and the bottom coating 36 is a sealant to enable the sealant sections 36*a*, 36*b* of the center web to be bonded to the bag walls 42, 44. If desired, a peel seal material may be applied as the top coating 38 to provide further protection to the package contents. In certain instances the peel seal may be formed on only one of the webs. In other cases, to facilitate breaking the peel seal, flanges 47 may be provided above the peel seal which may readily be grabbed by a consumer.

Figure 3:
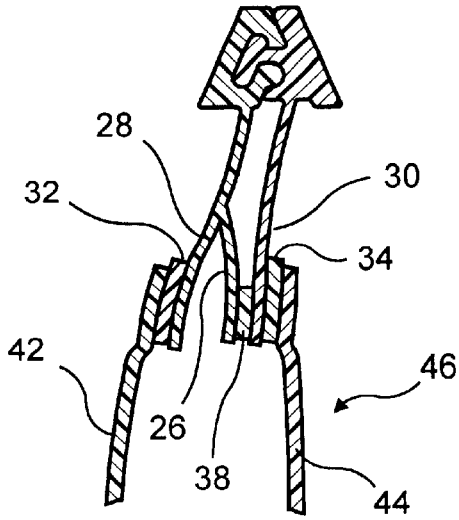
FIG. 3 is a fragmentary sectional view of a second package that may be formed with the zipper strip of FIG. 1 when suitably coated.

In FIG. 3 a package 46 is depicted wherein the center web 26 is severed at "B". The coating 38 on top surface of the center web is a peel seal material while a sealant is applied as the coatings 32, 34 on the top surfaces of the outer webs 28, 30. With this arrangement the outer webs 28, 30 may be hard sealed to the bag walls 42, 44 while the middle web 26 is peel sealed to arm 16 or outer web 30 depending on where cut B is made to form tamper evident protection for the package contents.

Figure 4:
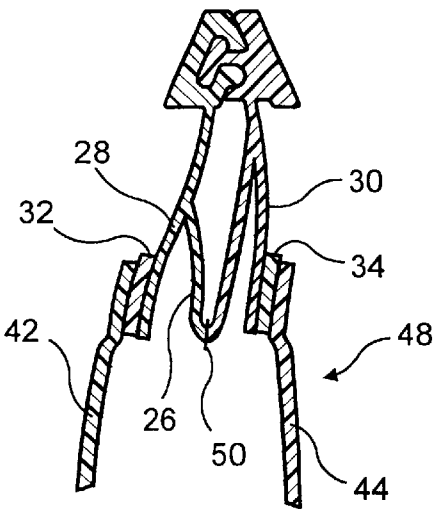
FIG. 4 is a fragmentary sectional view of a third package that may be formed with the zipper strip of FIG. 1 when suitably coated.

In FIG. 4 a package 48 is depicted which is similar to the package 46 of FIG. 3 except that the center web 26 is not severed. Instead a line of perforations 50 is provided at "A". The coatings 32, 34 enable a hard seal to be formed between the outer webs 28, 30 and the bag walls 42, 44. When the bag is initially opened, the consumer must rupture the perforation line 50 to gain access to the package contents and the ruptured perforation line provides evidence of such opening.

Figure 5:
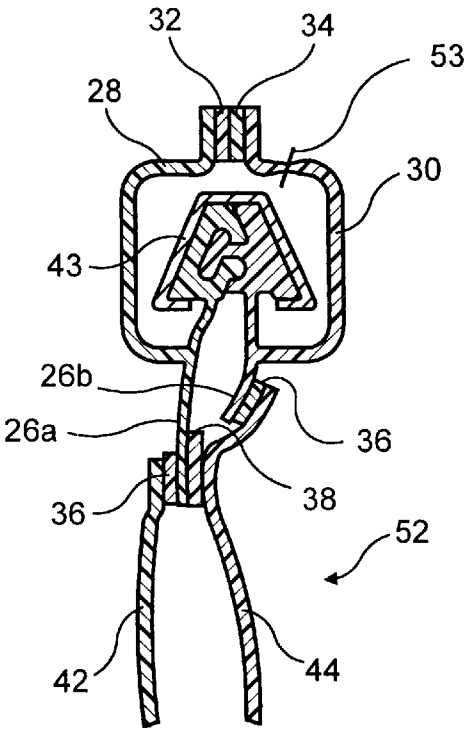
FIG. 5 is a fragmentary sectional view of a fourth package that may be formed with the zipper strip of FIG. 1 when suitably coated.

The outer webs 28, 30 of the package 52 of FIG. 5 are folded over the zipper elements to form a header as in the embodiment of FIG. 1. In this case the coatings 32, 34 on the top surface of outer webs is a sealant material joining the outer webs in a hard seal. To open the package a perforation line 53 is provided across web 30. The top coating 38 of the center web 26 is a peel seal material and the bottom coating 36 is a sealant. The bag walls 42, 44 are hard sealed to the bottom surfaces of segments 26*a*, 26*b* of the center web and the top surface of the center web segment 26*a* is peel sealed to the interior of the opposite bag wall 44.

Figure 6:
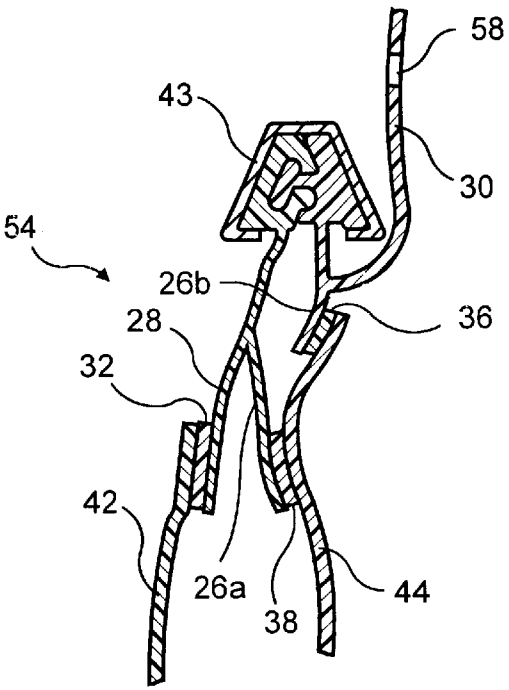
FIG. 6 is a fragmentary sectional view of a fifth package that may be formed with the zipper strip of FIG. 1 when suitably coated.

The package 54 of FIG. 6 has outer web 30 folded up to form a hang tag. A hole 58 is punched in the web to enable hanging the package from a rod. In package 54 the coating 32 on the top surface of outer web 28 is a sealant to facilitate sealing he web to package wall 42. The center web 26 has a peel seal material as a coating 38 on its top surface and a sealant as the coating material 36 on the bottom surface. The bottom surface of the center web segment 26*b* is hard sealed to bag wall 38 while the top surface of center web segment 26*a* is peel sealed to the interior surface of bag wall 44.

It can thus be seen that appropriately coating the top and/or bottom surfaces of the webs defining the zipper strip base, the zipper strip may be used to form a wide variety of packages.

Having thus described the invention, what is claimed is:

1. A zipper strip comprising:

a base member, a first profile and a second profile extending from said base member, said first profile comprising a first arm extending upwardly and perpendicularly from a first side of said base member and having a first interlocking member attached to said first arm, said second profile comprising a second arm extending upwardly and perpendicularly from the first side of said base member and having a second interlocking member, engageable with said first interlocking member, attached to said second arm;

said base member including a first web extending between said first and second arms; a second web, outboard of said first arm, with said first arm extending from said base member between said first web and said second web; and a third web, outboard of said second arm, with said second arm extending from said base member between said first web and said third web.

2. The zipper strip in accordance with claim 1 wherein said first profile is at a free end of said first arm and said second profile is at a free end of said second arm.

3. The zipper strip in accordance with claim 1 wherein portions of at least one surface of at least one of said webs includes a coating thereon.

4. The zipper strip in accordance with claim 1 wherein a top surface of at least one of said second and third webs is coated with a sealant.

5. The zipper strip in accordance with claim 1 wherein a top surface of said first web is coated with a peel seal material and a bottom surface of said first web is coated with a sealant.

6. The zipper strip in accordance with claim 4 wherein a top surface of said first web is coated with a peel seal material and a bottom surface of said first web is coated with a sealant.

7. The zipper strip in accordance with claim 1 wherein a top surface of at least one of said second and third webs is coated with a peel seal material.

8. The zipper strip in accordance with claim 7 wherein a top surface of said first web is coated with a peel seal material and a bottom surface of said first web is coated with a sealant.

9. The zipper strip in accordance with claim 3 wherein said coating comprises one of a sealant and a peel seal material.

10. The zipper strip in accordance with claim 1 wherein at least one of said webs includes a line of perforations extending across said at least one web.

11. The zipper strip in accordance with claim 1 further comprising a slider disposed upon said interlocking members.

12. The zipper strip in accordance with claim 1 further comprising a hang hole in one of said second and third webs.

* * * * *